United States Patent [19]

Runsten

[11] 4,391,694

[45] Jul. 5, 1983

[54] APPARATUS IN ELECTRO DEPOSITION PLANTS, PARTICULARLY FOR USE IN MAKING MASTER PHONOGRAPH RECORDS

[75] Inventor: Bengt W. Runsten, Stockholm, Sweden

[73] Assignee: AB Europa Film, Bromma, Sweden

[21] Appl. No.: 347,864

[22] Filed: Feb. 11, 1982

[30] Foreign Application Priority Data

Feb. 16, 1981 [SE] Sweden ..... 8101046

[51] Int. Cl.[3] ..... C25D 21/12; C25D 1/10

[52] U.S. Cl. ..... 204/273; 204/275; 204/5

[58] Field of Search ..... 204/5, 273, 275, 276

[56] References Cited

U.S. PATENT DOCUMENTS

| | | | |
|---|---|---|---|
| 2,675,348 | 4/1954 | Greenspan | 204/297 W |
| 3,186,932 | 6/1965 | Gelfand | 204/5 |
| 4,269,669 | 5/1981 | Soby | 204/275 |

FOREIGN PATENT DOCUMENTS

| | | | |
|---|---|---|---|
| 1503553 | 10/1967 | France | 204/5 |

*Primary Examiner*—T. M. Tufariello

*Attorney, Agent, or Firm*—Robert E. Burns; Emmanuel J. Lobato; Bruce L. Adams

[57] ABSTRACT

Apparatus in plants, particularly for use in making master phonograph records and the like.

In plants (FIG. 1) for galvanic processing in making master phonograph records, the apparatus in accordance with the invention comprises an arrangement of the receptacle (12) containing anode material (16) such that the electrolyte (2) is constrained (19, 35) to a given extent to flow through the receptacle in a direction from the surrounding liquid in a processing tub (1). The receptacle (12) is connected to an outlet (35) for liquid such that there is always a level (37) of liquid in the receptacle lower than the level thereof in the tub. By means of the liquid flow there is gained that particles which may be liberated from the anode material are not carried over to the object on which electro deposition takes place.

13 Claims, 2 Drawing Figures

APPARATUS IN ELECTRO DEPOSITION PLANTS, PARTICULARLY FOR USE IN MAKING MASTER PHONOGRAPH RECORDS

BACKGROUND OF THE INVENTION

In electro deposition for master phonograph records, it is customary to use metal in the form of cubes, granules or the like, as material for the anode. This material is placed in an electrically conductive receptacle with perforated walls for allowing the passage of the galvanic bath liquid and enabling the necessary ion migration. The receptacle is often in direct contact with a conductor placed in the bath and connected to the positive pole of a voltage supply. The conductor is usually titanium or other high-quality metal. For a galvanic deposition in very thin homogenous coatings it is important that particles do not become liberated from the anode material to form lumps in the coating on the object being coated. The anode material also contains chemicals which can disturb deposition on the matrix. In order to avoid such phenomenon, it is customary in the present state of the art to arrange a bag of some suitable textile, in which the anode material resides. The textile fabric must of course allow the easy passage of the bath liquid, while at the same time having a relatively dense structure to prevent small particles liberated from the anode material from streaming out into the bath liquid. To keep the bag intact while still providing good contact between said positive conductor and the anode material, contact means as described in the Swedish Pat. No. 7305397-7 can be used.

In spite of all precautions, it is occasionally unavoidable in practice that almost microscopic particles come into circulation in the bath liquid and become deposited on the matrix, resulting in a coating which is uneven in spots. Attempts have been made to solve the problem by arranging a further filter round the anode material receptacle, but it has been found that such arrangements unfavorably affect the galvanic deposition process. It is particularly desirable that a flow path which is as free and direct as possible shall exist between the anode material and the matrix, simultaneously as the bath liquid is brought into as intimate and turbulent flowing contact as possible with the anode material as well as the matrix.

SUMMARY OF THE INVENTION

The present invention relates to a solution of the above-mentioned problem, and in essentials utilizes an anode material receptacle having one or more openings situated below the liquid level in the tub containing the galvanic liquid or electrolyte, and also containing the matrix blank. The tub is disposed such that it controllably communicates with an outlet, a return conduit and/or a reservoir for the liquid, for maintaining the liquid level in the anode material receptacle below that prevailing in the tub Apart from said openings, the receptacle is impermeable to the tub liquid. What is achieved by the arrangement described is that the liquid in the tub will continuously have an excess pressure in relation to the liquid in the receptacle, resulting in the electrolyte continuously flowing towards the openings in the receptacle, and in through them, through the anode material and to the outlet of the receptacle. This results in that particles possibly liberated from the anode material by the galvanic process can never come out into the galvanic current path, since they cannot be pulled against the continuous flow of liquid towards the anode material in the receptacle. There is hereby effectively avoided every accidental material transport to the matrix blank that is not determined by the galvanic process as such.

What is characteristic for the present invention will be seen from the following claims.

BRIEF DESCRIPTION OF THE DRAWINGS

The invention will now be described while referring to the appended drawing, which illustrates an embodiment of it.

DETAIL DESCRIPTION OF THE INVENTION

Figure 1:
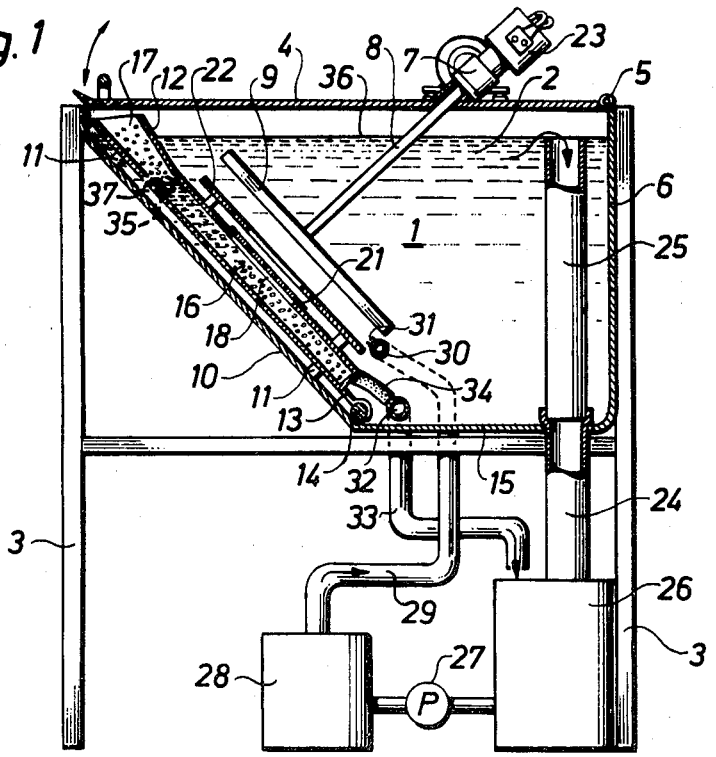
FIG. 1 illustrates a section of a plant for galvanic deposition of coating material for preparing master phonograph records, in which the present invention is applied.

The plant illustrated in FIG. 1 comprises a tub, generally denoted by the numeral 1 and containing a galvanic liquid 2. The tub is supported by a structure 3, and provided with a cover 4, pivotably supported by a hinge means 5 attached to the rear wall 6 of the tub. A gear box 7 with electric motor drive is mounted on the cover. A shaft 8 from the gear box goes obliquely through the cover and down into the tub 1. At its free end the shaft 8 carries a disk 9, on which may be mounted an object, e.g. an original phonograph record provided with the proper engraved grooves or distributed depressions (not shown) for being provided with a metal deposition.

Figure 2:
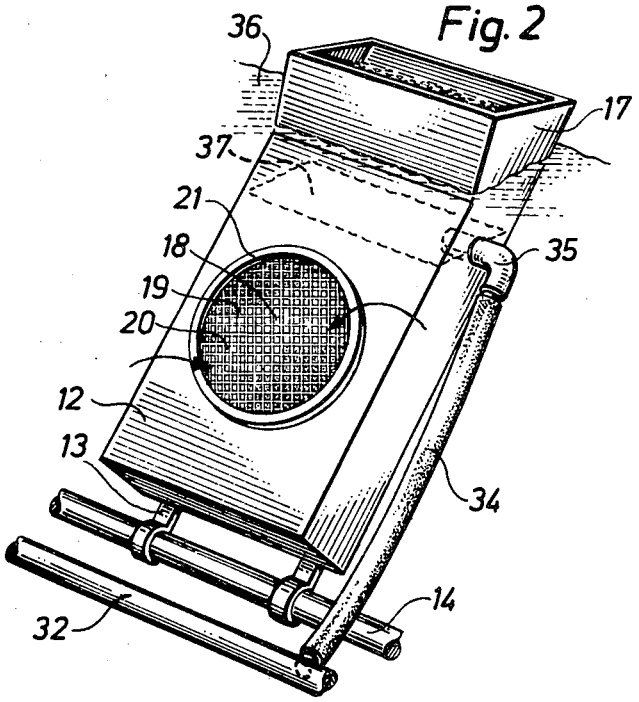
FIG. 2 illustrates to an enlarged scale the anode material receptacle in an apparatus in accordance with the invention.

The front wall 10 of the tub is inclined at an angle compatible with that of the record surface. On the inside of the front wall there are mounted electrically insulating support means 11, against which rests an anode material receptacle 12, preferably of titanium. The lower end of the receptacle is provided with projecting contact straps 13, coacting with an axially extending bus bar 14, insulated from, but attached to the tub bottom 15. Via the receptacle, the straps 13 are in contact with the granular anode material 16 therein. The receptacle is otherwise closed off, with the exception of a control opening 18, facing the disk 9, see FIG. 2. Said opening is provided with a grating 19, on which is stretched a textile cloth 20, by means of a clamping ring 21. A baffle plate 22 with a center hole is mounted on the receptacle between the rotatable disk and receptacle, with the object of guiding the galvanic currents, the ion migration, between the disk 9 and the anode material 16. The disk 9 is of course in contact, via the shaft 8 and slip contact means 23 on the gear box 7, with the negative pole of a current source.

The upper end of an outlet pipe 24 is arranged in the bottom 15 of the tub 1, and removably accommodates an overflow pipe 25 for maintaining liquid level in the tub. The pipe 24 is connected to a galvanic liquid reservoir 26, connected in turn to a circulation pump 27, the outlet side of which is connected to a filter 28. A delivery pipe 29 goes from the filter to a pipe 30 in the bath. This pipe has its delivery openings directed towards the space between the receptacle 12 and disk 9. A further pipe 32 extends along the tub bottom 15, and outside the tub this pipe is connected to a return pipe 33, in communication with the reservoir 26. The other end of the pipe 32 is connected to a hose 34, which has its upper end connected to a pipe connection 35, attached to one side of the receptacle 12, and communicating with the interior thereof at a point above the opening 19.

The plant functions in the following mode. When the pump 27 is started, the bath liquid flows from the reservoir 26, through the filter 28, the pipes 29 and 30 and out into the tub 1 via the orifices 31. Pumped-in liquid will recirculate via the mouth of pipe 25 down through it and pipe 24 to the reservoir 26. As will be clearly seen, the pipe 25 will decide the liquid level 36 in the bath 1. The interior of receptacle 12 is in communication with a free outlet to the reservoir 26, via the pipe connection 35, hose 34 and pipes 32 and 33. However, the mouth of the connection 35 is below the bath level 36, as will be clearly seen from the Figures. This means that when the receptacle 12 has become filled with liquid the latter will drain off via the connection 35 and connected conduits. There will thus be a liquid level 37 in the receptacle 12 which is below the liquid level 36. This means that the liquid 2 in the tub will exercise an excess pressure on the liquid in the receptacle 12, causing liquid continuously to flow through the cloth 20, grating 19 and opening 18 to the anode material 16. The result of this is that, apart from the turbulence caused in the liquid 2 in the tub 1, there will always be a stream of liquid directed towards the opening 19. If it is now assumed that particles of anode material are liberated therefrom during the progress of the process, these cannot be brought over to the matrix on the disk 9, since the liquid is continuously kept flowing such as to overcome the attraction force exerted.

As will be seen, a problem previously difficult to master has been solved in an extremely simple fashion. In the processes of today, it is of the greatest importance that the galvanic liquid is kept as free as possible from impurities and particles, bearing in mind, for example, that the production of video disks makes demands on the electro plating process which have never been present before. What has been shown above is only one embodiment, and a plurality of embodiments are conceivable within the scope of the invention. For example, there may be a plurality of openings 18 in the receptacle 12, if this is found suitable. What is essential is that there is sufficient liquid flow in towards the material in the receptacle. In the example shown, the receptacle 12 is removable from the tub and from the bus bar 14, which is of course advantageous from the point of view of cleaning and service. Residual products of anode material must namely be removed and the cloth 20 changed at regular intervals.

An embodiment may however be conceived, wherein the anode material receptacle constitutes an insulated pocket on the tub 1, mounted exteriorly on the front wall 10, the necessary holes being provided therein for communication with the pockets, which may be connected using means such as the pipe connection 35. In certain circumstances, when using such a connection, it may be suitable to have it attachable at different levels in the receptacle, above the opening 19, in order to obtain the correct rate of liquid flow through the receptacle. This may be arranged, for example, by providing a plurality of mutually spaced holes, each accommodating the connection, and closed off by a cover plate when not in use, or a device which is displaceable along the side of the receptacle. For emptying the tub 1, the pipe 25 is conventionally removable, whereby the liquid departs directly to the reservoir 26.

The illustrated arrangement of the pipes 30 and 32 is extremely suitable in conjunction with arranging a plurality of tubs side-by-side, since these pipes can be directly connected from tub to tub by simple means. In this connection, it is pointed out that the pipe 32 may conceivably be connected directly to the outlet pipe 24 instead of to a separate outlet pipe 33, as shown here.

I claim:

1. Apparatus including: a tub (1) intended for plating electrolyte and having an overflow pipe (25) having an open end within the tub (1) for discharging electrolyte that exceeds a predetermined level (36), at least one receptacle (12) for anode material participating in the electro deposition process, and means (24–30) for circulating and maintaining the level of the electrolyte in the tub, the receptacle (12) having one or more openings (18) situated under the liquid level (36) in the tub, characterized in the receptacle communicates with an outlet (35) arranged at a level between said opening (18) and the liquid level (36) in the tub (1), said outlet being in communication with return piping (32,33) for the electrolyte (2), whereby the liquid level (37) in the receptacle will be below that (36) prevailing in the bath (1), so that the liquid (2) circulating in the tub (1) partially departs through said opening (18), subsequently to flow through the anode material (16) and to the outlet (35) in said receptacle.

2. Apparatus as claimed in claim 1, characterized in that the outlet of the receptacle (12) is formed as a pipe connection (35) arranged between the respective opening (18) and the liquid level (36) in the tub (1) and in communication with a reservoir (26) via conduits (32, 33 and 34).

3. Apparatus as claimed in claim 2, characterized in that the position of the pipe connection (35) between the opening (18) and the bath level (36) is variable for regulating the flow of liquid through the opening (19).

4. Apparatus as claimed in any of the preceding claims, characterized in that a hose (34) is connectable to the connection (35), the hose being in communication with a pipe extending straight through the tub (1), and thus enabling connection of corresponding pipes in tub (1) arranged side-by-side, said pipes being commonly connected (33) to a reservoir.

5. An electro-deposition apparatus, comprising:

a tank for containing a liquid electrolyte used for electroplating, said tank having an outlet for discharging liquid electrolyte therefrom when liquid electrolyte within said tank exceeds a certain predetermined level;

a receptacle for anode material, said receptacle having a side with an opening therethrough opening into the interior of said tank for providing communication between the interior of said tank and the interior of said receptacle; and discharge means for discharging liquid electrolyte from the interior of said receptacle below the predetermined level of liquid electrolyte to the exterior of said tank without communicating with the interior of said tank, wherein liquid electrolyte within said tank having a level greater than liquid electrolyte within said receptacle flows through the opening into said receptacle under the influence of gravity and is discharged from said receptacle by said discharge means.

6. An electro-deposition apparatus according to claim 5 further comprising:

a reservoir for liquid electrolyte;

means comprised of a conduit for delivering liquid electrolyte discharged from said tank outlet to said reservoir;

said discharge means discharging liquid electrolyte from the interior of said receptacle into said reservoir; and means for supplying liquid electrolyte from said reservoir into said tank in sufficient amounts to maintain the level of liquid electrolyte within said tank at said predetermined level.

7. An electro-deposition apparatus according to claim 5, wherein:

said tank outlet is comprised of a conduit within said tank having an open end at said predetermined level, said conduit extending through a wall of said tank for discharging externally of said tank liquid electrolyte which exceeds said predetermined level and flows into said open end of said conduit.

8. An electro-deposition apparatus according to claim 7, wherein said conduit comprising said tank outlet is comprised of a section of conduit within said tank and oriented generally vertical with the opening in said conduit open end substantially horizontal and in the plane of said predetermined level.

9. An electro-deposition apparatus according to claim 6, wherein said tank outlet is comprised of a conduit within said tank having an open end at said predetermined level and extending through a wall of said tank for discharging externally of said tank liquid electrolyte which exceeds said predetermined level and flows into said open end of said conduit.

10. An electro-deposition apparatus according to claim 9, wherein said conduit comprising said tank outlet is comprised of a section of conduit within said tank and oriented generally vertical with the opening in said conduit open end substantially horizontal and in the plane of said predetermined level.

11. An electro-deposition apparatus according to claim 5, wherein said receptacle is a box having a major side wall having said opening therethrough, said opening providing the only communication between the interior of said box and the interior of said tank, whereby liquid electrolyte within said tank maintained at said predetermined level higher than the liquid electrolyte within said receptacle flows through said opening only in the direction from said tank into said receptacle.

12. An electro-deposition apparatus, comprising:

a tank for liquid electrolyte;

a container for anode material, said container having an opening therethrough opening into the interior of said tank for providing the only communication between the interior of said tank and the interior of said container;

means comprised of a conduit for discharging liquid electrolyte from the interior of said tank, said conduit having an intake opening within said tank for defining an intake through which liquid electrolyte within said tank enters said conduit and is discharged from said tank, and said conduit being oriented to position said intake opening within said tank for discharging liquid electrolyte from said tank that exceeds a certain predetermined level within said tank;

electrolyte supply means for supplying liquid electrolyte into said tank as electrolyte is being discharged from said tank; and discharge means for discharging liquid electrolyte from the interior of said container below the predetermined level of liquid electrolyte to the exterior of said tank without communicating with the interior of said tank, wherein liquid electrolyte within said tank having a level greater than liquid electrolyte within said container flows through the opening into said container under the influence of gravity and is discharged from said receptacle by said discharge means while the level of electrolyte within said tank is simultaneously maintained at said predetermined level.

13. An electro-deposition apparatus according to claim 12, wherein said discharge means is comprised of a conduit from said container to the exterior of said tank for providing communication between the interior of said container and the exterior of said tank and opening into said container at an elevation higher than the opening through said container and lower than said intake opening of said means for discharging liquid electrolyte from the interior of said tank.

* * * * *